US011806603B1

(12) United States Patent
Fox

(10) Patent No.: US 11,806,603 B1
(45) Date of Patent: Nov. 7, 2023

(54) SKATEBOARD TRUCK ASSEMBLY

(71) Applicant: Jeremy Fox, Huntington Beach, CA (US)

(72) Inventor: Jeremy Fox, Huntington Beach, CA (US)

( * ) Notice: Subject to any disclaimer, the term of this patent is extended or adjusted under 35 U.S.C. 154(b) by 98 days.

(21) Appl. No.: 17/396,366

(22) Filed: Aug. 6, 2021

Related U.S. Application Data

(60) Provisional application No. 63/062,771, filed on Aug. 7, 2020.

(51) Int. Cl.
*A63C 17/00* (2006.01)
*A63C 17/01* (2006.01)

(52) U.S. Cl.
CPC ..... *A63C 17/012* (2013.01)

(58) Field of Classification Search
CPC ..... A63C 17/012
See application file for complete search history.

(56) References Cited

U.S. PATENT DOCUMENTS 4,159,830 A * 7/1979 Solimine ..... A63C 17/01 280/11.28
6,443,471 B1 * 9/2002 Mullen ..... A63C 17/01 280/87.042
9,144,730 B1 * 9/2015 Visinski ..... A63C 17/0093
11,491,390 B1 * 11/2022 Piumarta ..... A63C 17/015
2004/0145142 A1 * 7/2004 Wang ..... A63C 17/012 280/87.042
2006/0087087 A1 * 4/2006 Stratton ..... A63C 17/015 280/11.27
2006/0097470 A1 * 5/2006 Chmelar ..... A63C 17/0093 280/87.042
2013/0069331 A1 * 3/2013 Yamada ..... A63C 17/012 280/87.042
2013/0270781 A1 * 10/2013 Kuyt ..... A63C 17/012 280/11.27
2015/0265907 A1 * 9/2015 Blanchard ..... A63C 17/012 280/87.042
2016/0023088 A1 * 1/2016 Aamodt ..... A63C 17/0093 280/11.28
2017/0203193 A1 * 7/2017 Powell ..... A63C 17/015

* cited by examiner

*Primary Examiner* — Brian L Swenson
(74) *Attorney, Agent, or Firm* — Advantage IP Law Firm

(57) ABSTRACT

A truck assembly having a truck hanger with a flange and a pivot pin extension that may be inserted into a pivot cup of a mounting plate with a well with a pair of complementary fasteners aligning and securing a pair of bushings with a first portion of one bushing disposed within the well to restrain lateral movement of the first bushing when the hanger is tilted relative to the mounting plate whereby deformation of a bore of the bushing relative to one of the fasteners passing therethrough is reduced or eliminated while a second section assists in restoring the hanger back to an untilted orientation relative to the mounting plate.

19 Claims, 6 Drawing Sheets

SKATEBOARD TRUCK ASSEMBLY

CROSS-REFERENCE TO OTHER APPLICATIONS

This application claims the benefit of U.S. provisional application No. 63/062,771, filed on Aug. 7, 2020, and which is hereby incorporated by reference in its entirety.

BACKGROUND OF THE INVENTION

1. Field of the Disclosure

The present disclosure relates broadly to riding platform constructions, and more specifically, to improvements in skateboard truck construction.

2. Background Art

As shown FIGS. 1-3 for example, a conventional skateboard truck 20 includes a hanger 22 with a flange section 24 and an axle section 26 extending outwardly into a pair of opposing axles 28*a*, 28*b*. A pair of wheels (not shown) may be mounted to the axles. A pivot pin 30 extends from the hanger. The truck also includes a base plate 32 that includes a flat undersurface 34 for abutting the underside of a skateboard deck. The base plate includes a set of bolt holes 36 for receiving the bolt fasteners to secure the base plate to the deck. The opposing side of the base plate includes a pivot cup 38, which may or may not include a pivot bushing, for receiving the end of the pivot pin 30. A cup washer receptacle 40 projects from the base plate at an angle and includes a threaded central bore (not shown). Atop the cup washer receptacle is a cup washer 42 on which a first bushing 44 is sandwiched between the cup washer 42 and the undersurface 46 of the hanger flange 22. This first bushing is typically cylindrical or frustoconical and includes a hole passing therethrough. Located atop flange 24 is a second bushing 48 that is frustoconical as shown in FIG. 3 and includes a central bore. A second cup washer 50 sits atop the second bushing. Finally, a kingpin 52 is inserted through the second cup washer 50, second bushing 48, flange 24, first bushing 44, first cup washer 42, and into a threaded bore in the cup washer receptable 40 and locked in place with a nut 54 to secure the hanger 22 to the base plate 32.

In use, the bushings, especially the bushing 44 sandwiched between base plate 32 and hanger flange 24 dictate the responsiveness and resistance of the truck 20 to departing from a level riding platform to a tilted deck when turning. Tightening or loosening the kingpin nut 54 is a primary method of changing the responsiveness and relative "looseness" of the truck. For example, a relatively tight kingpin nut will compress the base plate side bushing 44 more creating additional resistance to turning while a relatively loose kingpin nut will compress the base plate side bushing 44 to a lesser extent allowing the truck and attached skateboard deck to make sharper turns and generally be more maneuverable. Alternative bushings with different hardness ratings may be used to vary the "stiffness" or "looseness" of the ride as well.

Loose trucks are often desirable to the rider but are also increasingly unstable resulting in increased deck wobble relative to the hanger and attached wheels. Such looseness often results in "wheel bite" or "wheel rub" wherein the compressed side wheel actually makes contact with the underside the deck acting as a brake and stopping the rolling motion of the skateboard, much to the detriment of the rider who is often propelled off the skateboard. A potential fix is to wax the likely areas of wheel rub to lessen the severity of the braking action. However, this requires the rider to frequently wax and maintain the area. As a result, riders frequent vary the tightness of the trucks depending on the type of ride sought until a tradeoff between maneuverability and stability is achieved.

As shown in FIGS. 4-6, once the hanger 22 tilts relative to the base plate 32 and underside of the skateboard deck, such as frequently occurring during a turning maneuver or landing on a support surface at an angle, the cylindrical or frustoconical bushing 44 is compressed along one side 56 and stretched on the opposing side 58. While the compression/expansion of opposing sides 56, 58 of the cylindrical or frustoconical bushing 44 is routine under normal riding conditions, the conventional truck configuration creates several issues that result in the degradation of the bushing 44 and responsiveness of the truck 20 in use over time.

The first issue often posed by the conventional truck construction may be described as "popout" and occurs when the lower edge 60 of the stretched side 58 of the bushing 44 slips out and over the relatively low sidewall 62 of the lower cup washer 42. As a result, the bushing is not constrained within the confines of the lower cup washer and the popped out region 60 must overcome the resistance of cup washer sidewall 22 to return to a central position.

A related issue is posed by the sidewall 62 of the lower cup washer 42 since the sidewall presents a sharp outer edge which engages a portion of the bushing during use and over time and creates a wear region on the bushing where the surface of the bushing repeatably slides over the sharp outer edge of the cup washer.

Yet another issue commonly encountered is the enlargement of the central bore 64 of the bushing 44 as the stretched side is pulled away from the kingpin 52 leaving an enlarged opening 66 to one side of the kingpin. This frequent stretching of the central region of the bushing 44 creates a loose fit between the kingpin 52 and surrounding bushing 44. The aperture through which the kingpin extends through the bushing commonly stretches out creating a loose fit between the bushing and kingpin. Often, this stretched portion is asymmetrical and creates an uneven riding experience on one side or the other. Moreover, the bushing degrades much quicker over time which reduces the responsiveness of the truck. This elongation and distortion of the inner bore and consequentially, the overall geometry of the lower bushing, harms the ability of the truck to return to center and impairs the riding experience.

It will be appreciated that all the foregoing issues contribute to "chewing" up and deforming the bushing 44 further degrading its ability to return the truck to a level center position from a tilted position. Such degradation increases the likelihood of an uncontrollably loose truck increasing the likelihood of undesirable wheel rub. In addition to the riding experience degradation and safety issues posed by the degraded bushing, the bushings must be maintained and replaced more often than necessary which adds to the overall maintenance time and ownership costs over a lifetime of the skateboard.

Given the drawbacks of the prior approaches to a skateboard truck, there exists a need for an improved skateboard truck construction better able to withstand the forces imparted on the bushings during use.

BRIEF SUMMARY

In accordance with the embodiments disclosed herein, a truck assembly for use with a skateboard deck and a set of skateboard wheels may entail employing a truck hanger with a pivot pin extension and a flange with an aperture along with a mounting plate having a pivot cup to receive the pivot pin extension and a bushing receiving well at least partially defined by a sidewall extending from the mounting plate and terminating in a truck hanger facing rollover edge while a multi-diameter bushing may extend from the hanger flange and into the well and also extending beyond the rollover edge that may be paired with a second bushing aligned using a first fastener and sandwiched between a complementary fastener and the flange. Such configuration aims to inhibit relative movement between a portion of the multi-diameter bushing and the well to avoid bushing popout and deformation issues.

In further accordance with the principles and embodiments described herein, at least one bushing includes a constant diameter section to secure one end of the bushing within the well while also providing an enlarged diameter section that may cooperate with the rollover edge and the flange to restore an untilted configuration between the hanger and mounting plate.

In yet another embodiment, the truck assembly may incorporate a kingpin and nut to secure the hanger to the mounting plate and position the bushings.

In yet another embodiment, the multi-diameter bushing transitions from a constant diameter to an outwardly tapering diameter proximate the rollover edge.

Methods of assembling a truck incorporating a multi-diameter, partially captured bushing are also disclosed herein.

DETAILED DESCRIPTION OF THE PREFERRED EMBODIMENTS

Figure 1:
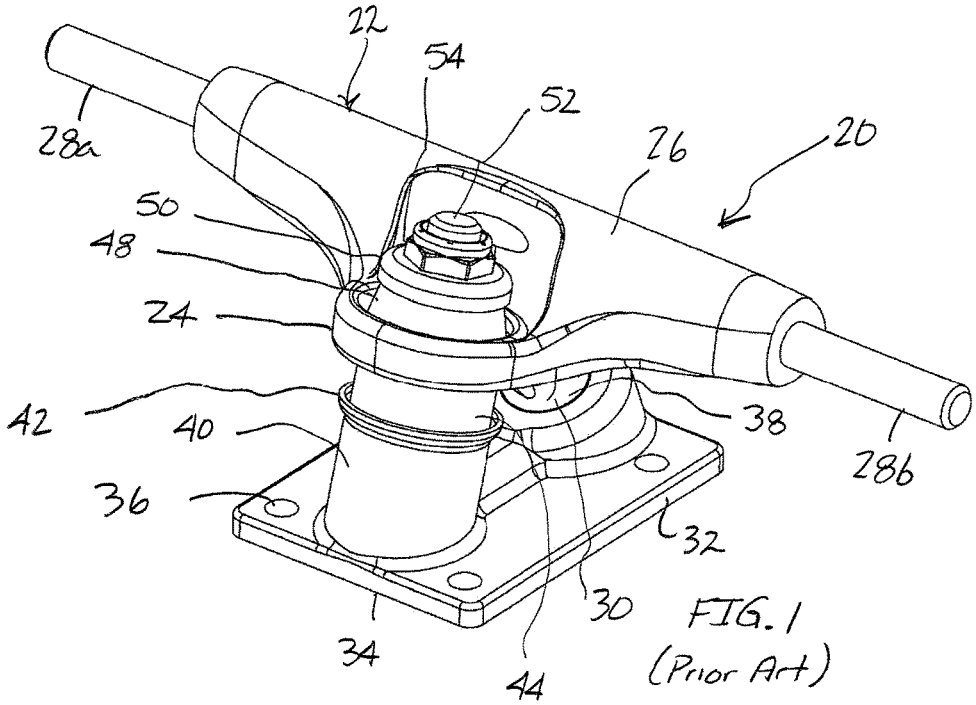
FIG. 1 (Prior Art)
FIG. 1 is a perspective view of a conventional skateboard truck in a level or untilted configuration.
Figure 3:
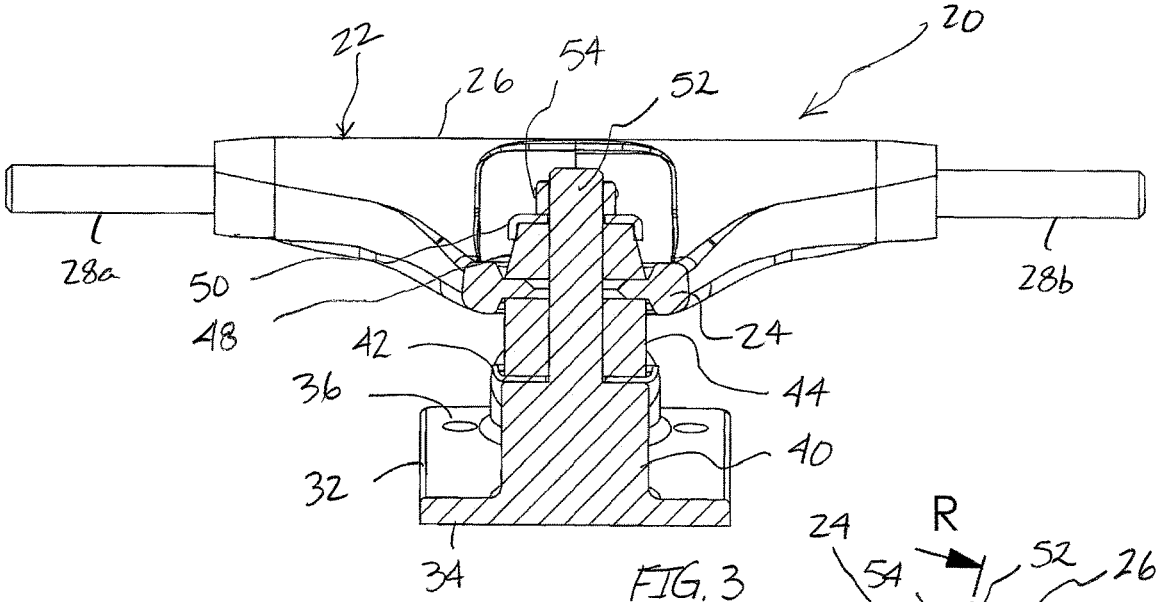
FIG. 3 (Prior Art)
FIG. 3 is a cross-sectional view taken along line R-R of FIG. 2.
Figure 2:
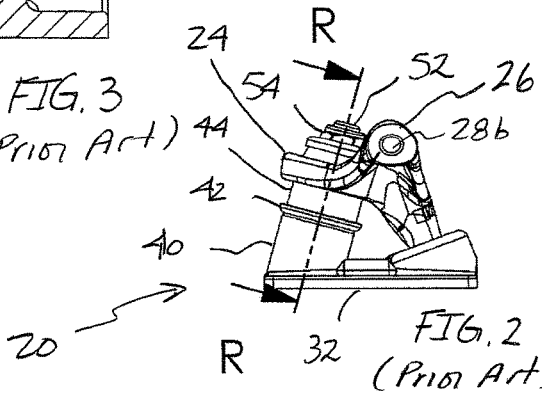
FIG. 2 (Prior Art)
FIG. 2 is a right side view of the conventional skateboard truck of FIG. 1, in reduced scale.
Figure 4:
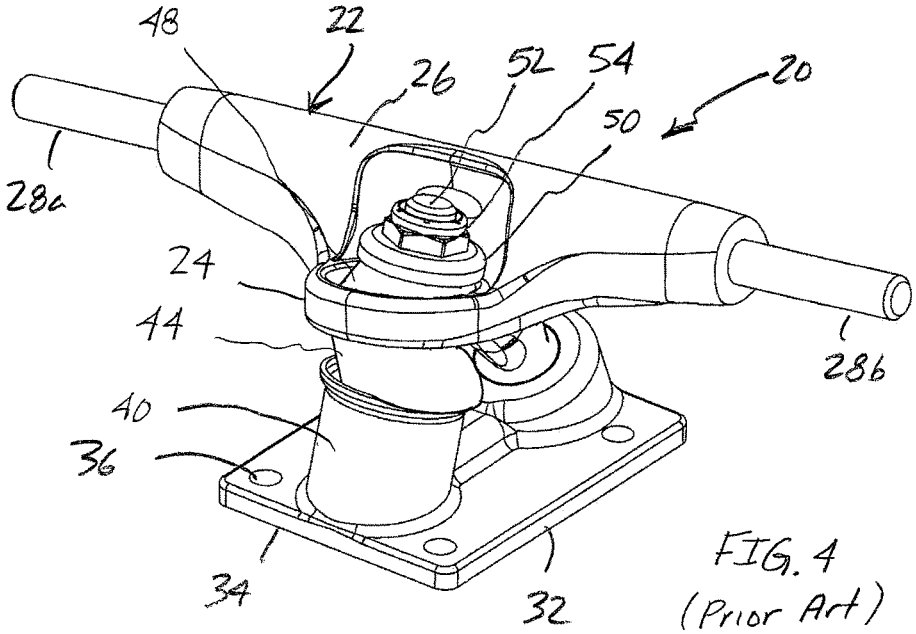
FIG. 4 (Prior Art)
FIG. 4 is a similar view to FIG. 1 of the conventional skateboard truck in a tilted or turning configuration.
Figure 6:
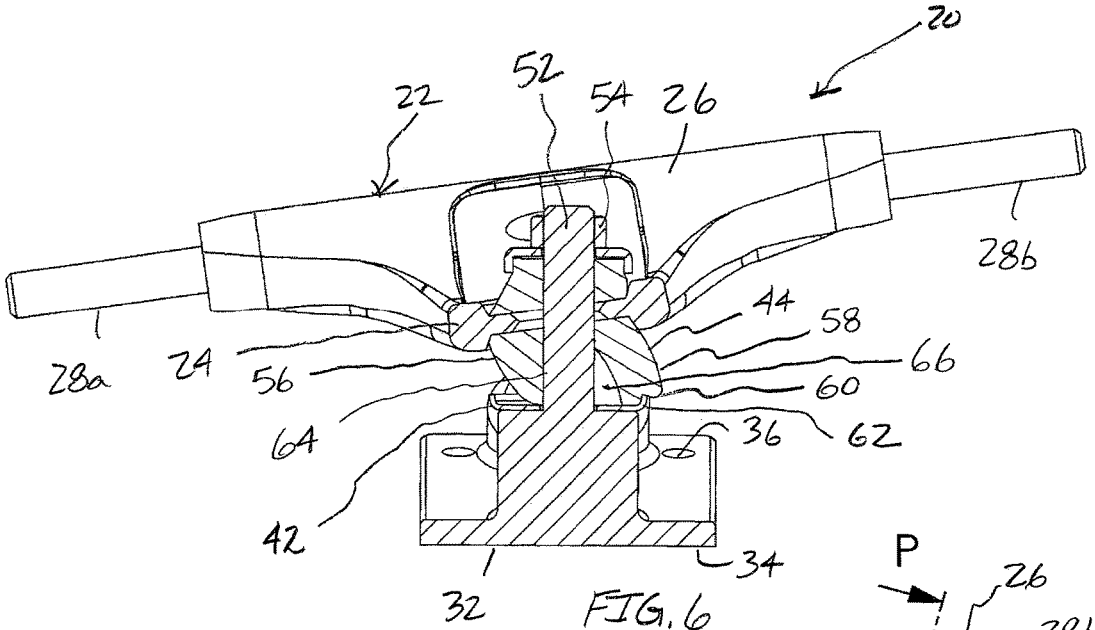
FIG. 6 (Prior Art)
FIG. 6 is a cross-sectional view taken along line P-P of FIG. 5.
Figure 5:
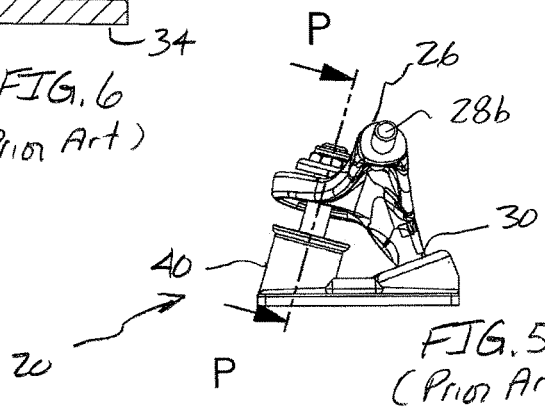
FIG. 5 (Prior Art)
FIG. 5 is a right side view of the conventional skateboard truck of FIG. 4, in reduced scale.

An improved skateboard truck assembly, generally designated 120, is depicted in FIGS. 7-14 and introduces a bushing well and an alternative bushing construction acting in concert to overcome one or more drawbacks posed by conventional skateboard truck designs. In general terms, the improved skateboard truck assembly 120 has a hanger, generally designated 122, with a kingpin receiving flange section 124 and an axle section 126 extending laterally from the flange section and terminating in a pair of opposing axles 128*a*, 128*b* on which a set of wheels (not shown) may be rotatably mounted with a race bearing disposed between. Alternatively, the axle may be rotatably mounted relative to the axle section on one or more bearings and the wheels fixed to the exposed axle portions. Extending from the axle section is a pivot pin 130.

Figure 7:
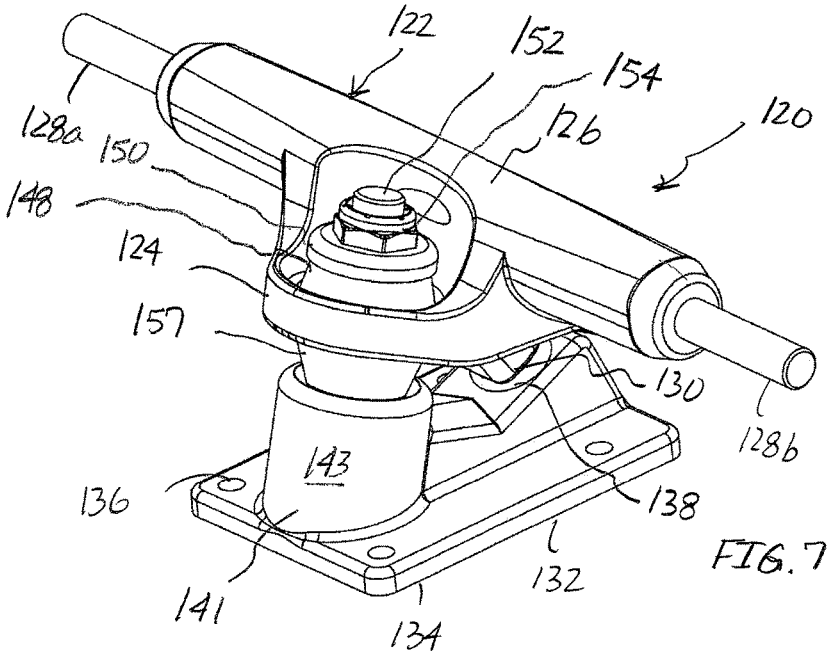
FIG. 7 is a perspective view of an exemplary embodiment of an improved skateboard truck assembly.
Figure 9:
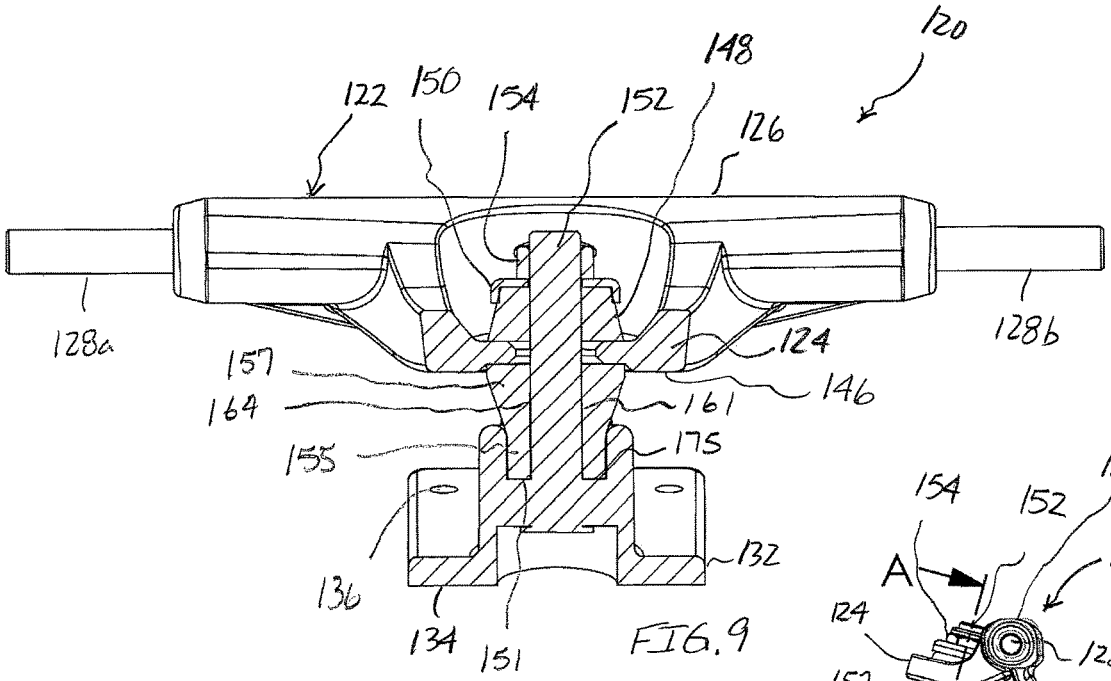
FIG. 9 is a cross-sectional view taken along line A-A of FIG. 8.
Figure 8:
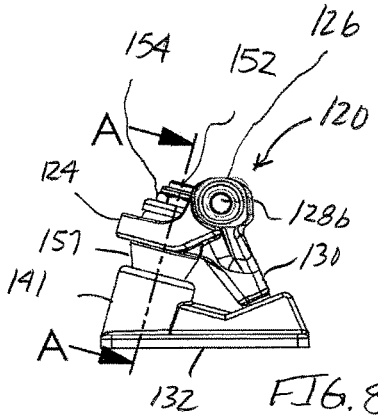
FIG. 8 is a right side view of the truck assembly of FIG. 7, in reduced scale.

With continued reference to FIGS. 7-9, the skateboard truck assembly 120 further includes a mounting plate 132 with a relatively flat plate section having a mounting surface 134 for abutting the underside 135 (FIG. 14) of the skateboard deck 137 and a set of bores or bolt holes 136 passing through for receiving a set of fasteners, typically bolts, which may be used to fasten the mounting plate to the underside of the skateboard deck using complementary fasteners, typically nuts. Projecting at a first inwardly projecting angle is a pivot cup 138 for receiving the distal end 139 (FIG. 13) of the pivot pin 130 of the hanger 122. Also projecting at a second inwardly projecting angle is a bushing well 141 wherein the extension of a central axis projecting through the bushing well intersects the extended central axis projecting through the pivot cup 138. The bushing well 141 is constructed with a raised cylindrical wall 143 projecting from flat plate section of the mounting plate 132 and at least partially or completely surrounding a hollow interior 145. In other words, the raised cylindrical wall, collar, or sidewall may have gaps or may also be in the form of a solid surrounding wall. The uppermost edge 147 of the cylindrical wall defines a rim 149, preferably curved and smooth, which appears as an arch shape in cross-section as in FIG. 9. A flat surface 151 forms the bottom of the bushing well 141. The bottom of the well may include openings or ribs to lighten the structure as well and does not have to coincide with the lowest extent of the sidewall and may be recessed from the lowest extent of the sidewall. The bottom of the well may also provide a support for a portion of the kingpin 152 which generally projects through the well.

As shown in cross-section in FIG. 9, the mounting plate side bushing, generally designated 153, includes a first cylindrical section 155, with a substantially constant diameter, that fits within, is partially captured by, or nested within the bushing well 141. This is the captured portion of the mounting plate side bushing. From the captured portion 155 at approximately the location of the rollover edge, the bushing 153 transitions to an outwardly tapered section 157 that terminates in a generally flat, circular, upper surface 159, as viewed in FIG. 9, that abuts the undersurface 146 of the hanger (kingpin receiving) flange 124. Together, the first section 155 and the second section 157 cooperate to define a generally modified bushing shape with a lower conical section 155 that projects into the bushing well 141 or complementary form receiving cavity from an upper inverted frustoconical section 157 with the transition diameter being less than the uppermost diameter at the upper surface 159. A central kingpin receiving bore 161 projects vertically through the bushing 153. This bushing 153 is preferably formed or otherwise constructed as a single integral unit but connected multiple sections are also contemplated. In this exemplary embodiment, the first and second sections 155, 157 are approximately the same height along a longitudinal axis projecting the bore 161 of the bushing 153.

Still referring to FIGS. 7-9, a second bushing 148 sits atop of the upper surface 170 of the flange 122. This bushing is frustoconical with the narrow end being on top. An upper cup washer 150 sits atop the second bushing 148. Projecting out of the bushing well 141 is the kingpin 152 (shown unthreaded in FIG. 10) which projects through the lower bushing 153, flange 122, upper bushing 148, upper cup washer 150 to leave a small exposed threaded post onto which the complementary kingpin nut 154 may be fastened. The tightness of the kingpin nut impacts the relative looseness of the truck hanger relative to the mounting plate 132 and attached skateboard deck 137.

With the foregoing configuration in mind as shown in FIGS. 7-14, it will be appreciated that the truck performance, maintenance period, and safety will be improved due to the interaction of the bushing well 141 and partially captured bushing 153. More specifically, as shown in cross-section in FIG. 9, when the hanger 122 is untilted or level, such as when riding straight ahead or without a rider, the captured portion 155 of the lower bushing 153 has parallel sidewalls 171, 173 positioned within the raised sidewall 143 of the bushing well 141. In addition, the outwardly tapering sidewalls of the second section 157 of the lower bushing 153 merely assist in retaining the hanger level with the mounting plate 132 by providing a relatively flat uppermost surface 159 to support the undersurface 146 of the flange 124. The bottom cylindrical surface 175 (FIG. 9) of the lower bushing 153 remains bottomed out and abuts the bottom 151 of the bushing well 141, although there may be a slight gap as well.

Figure 10:
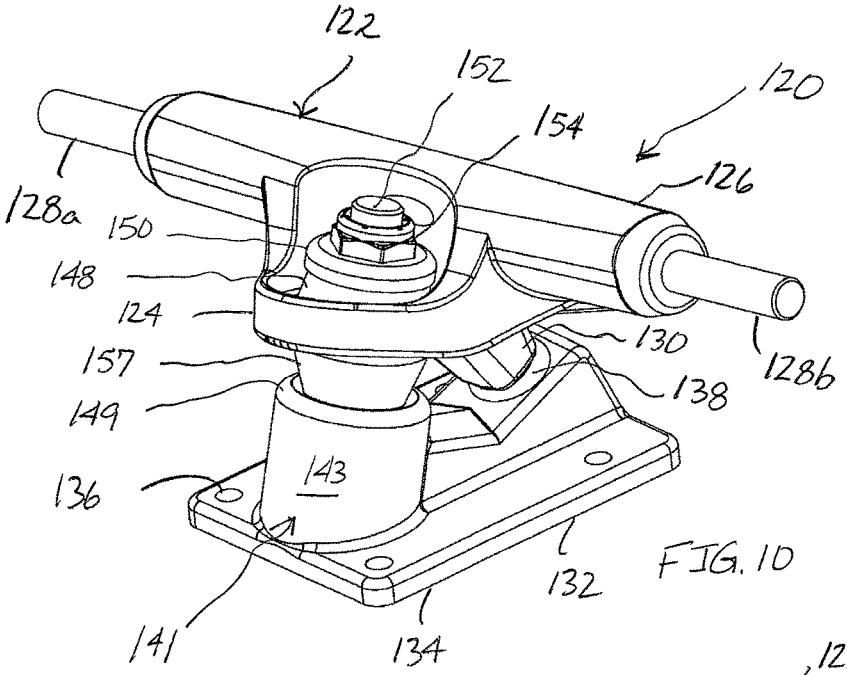
FIG. 10 is a similar view to FIG. 7 with the exemplary truck assembly in a tilted or turning configuration.
Figure 12:
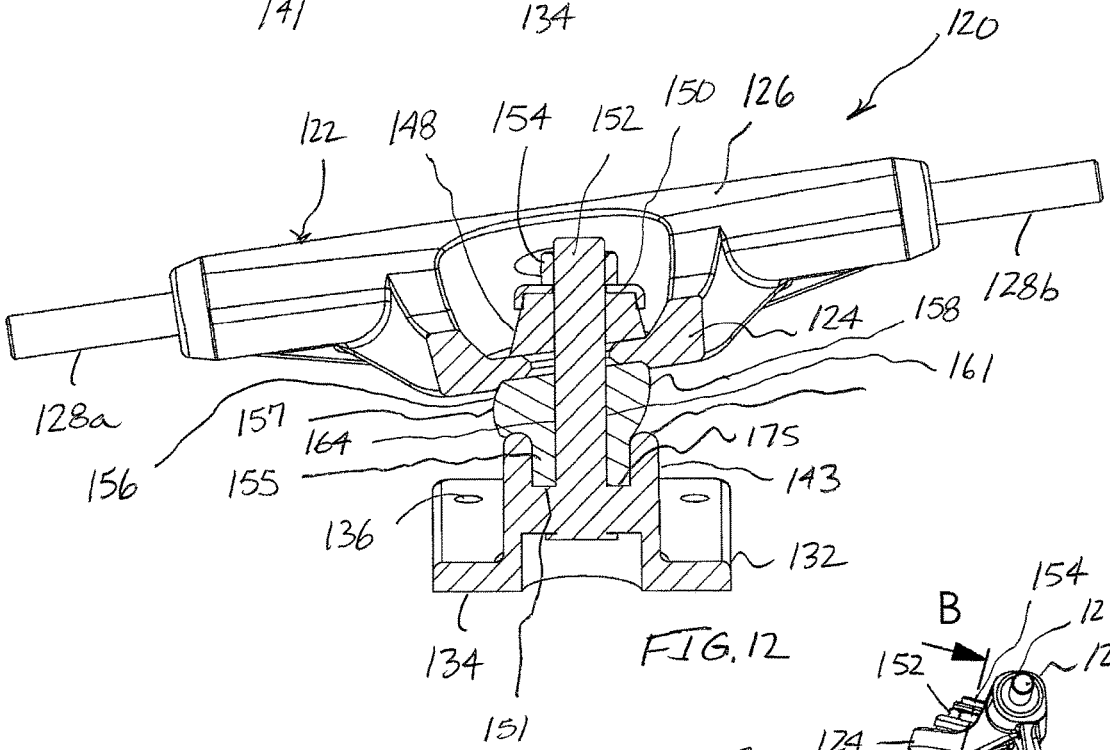
FIG. 12 is a cross-sectional view taken along line B-B of FIG. 11.
Figure 11:
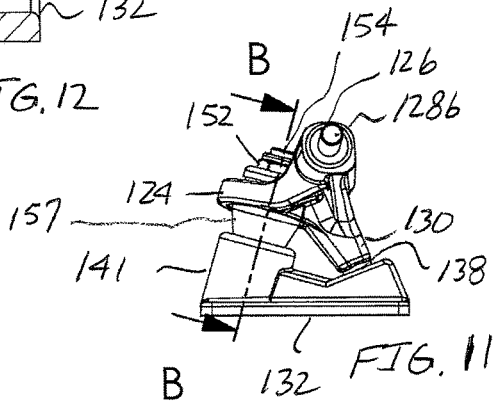
FIG. 11 is a right side view of the truck assembly of FIG. 10, in reduced scale.
Figure 13:
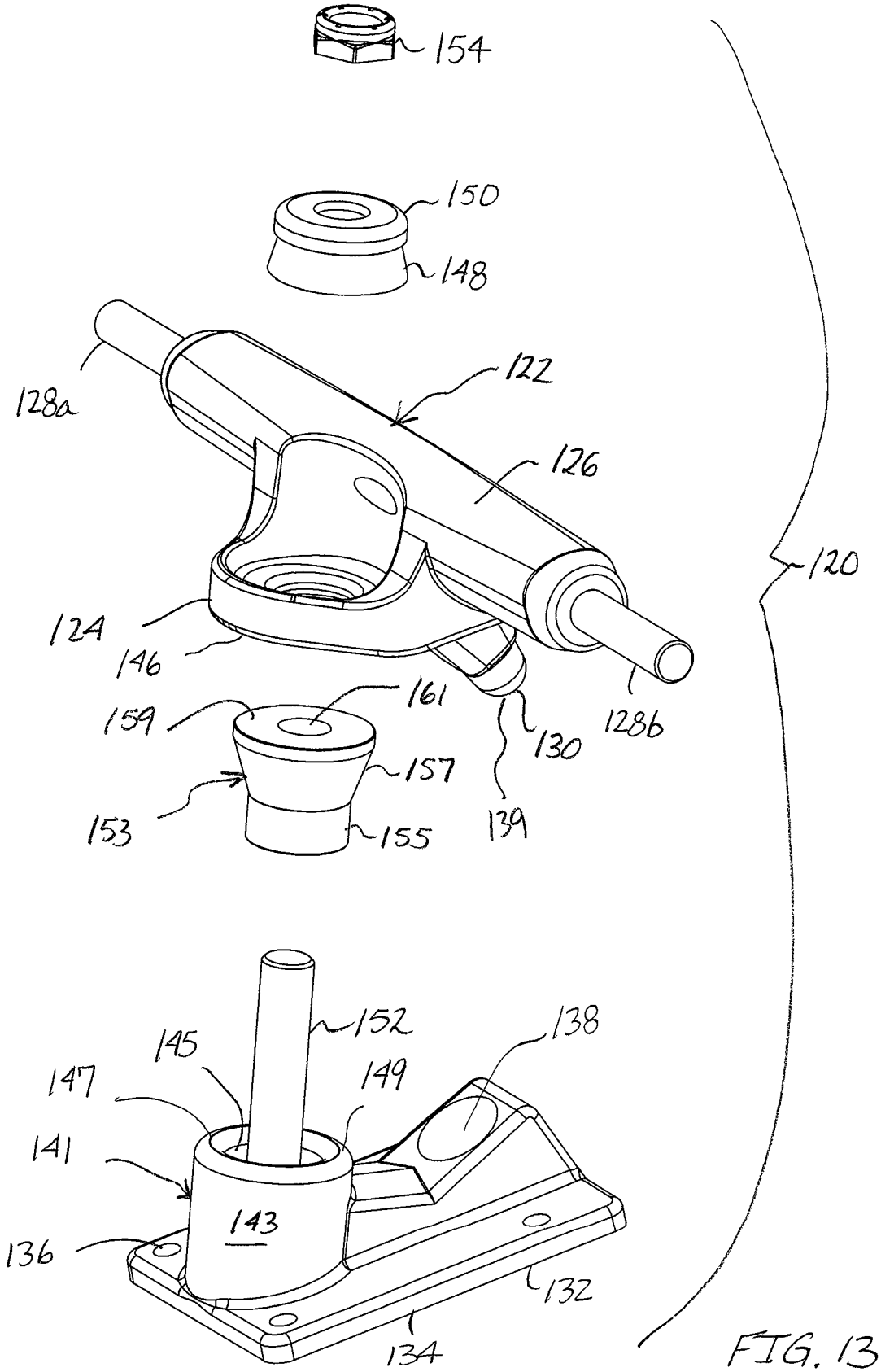
FIG. 13 is an exploded view of the exemplary truck assembly shown in FIGS. 7-12.
Figure 14:
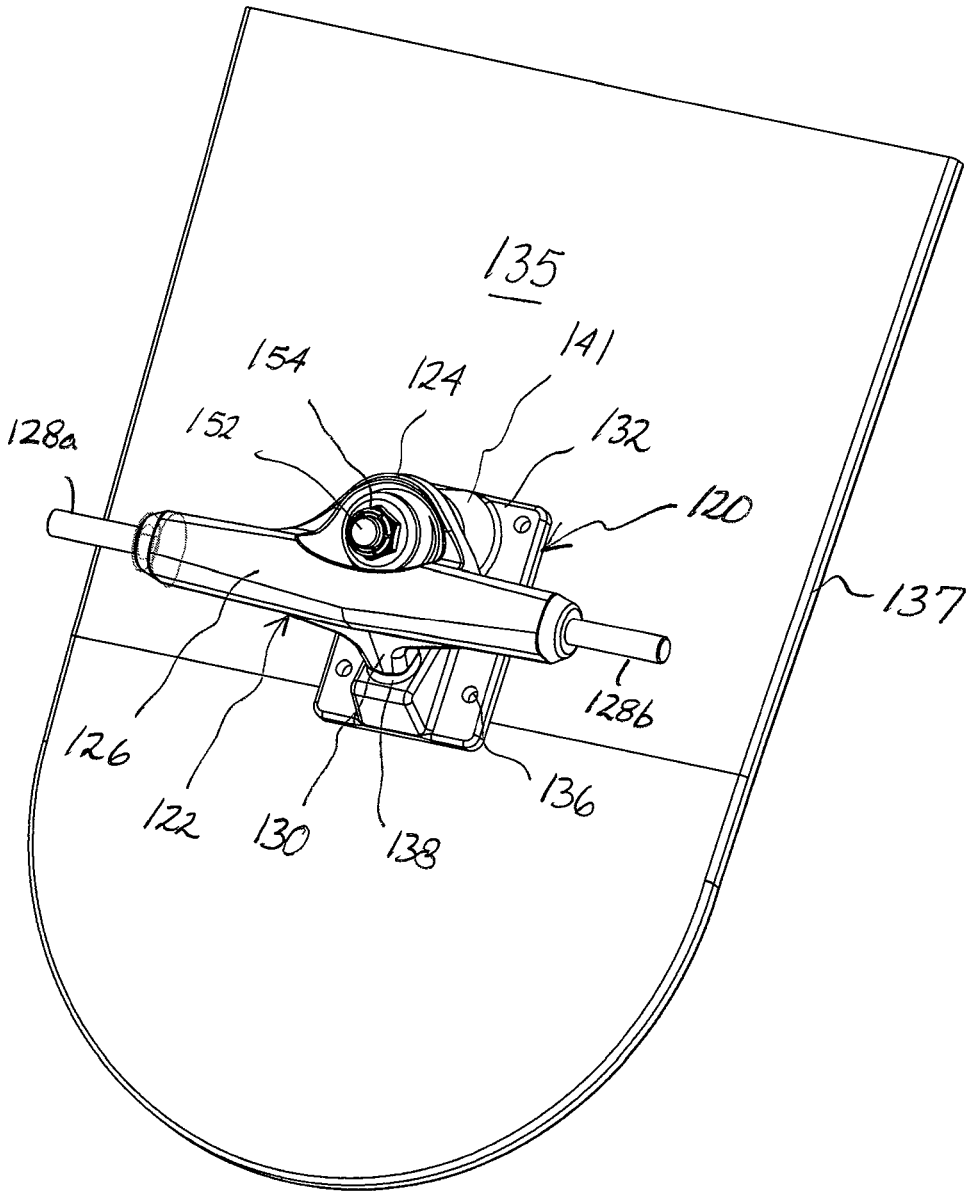
FIG. 14 is a perspective view of the exemplary truck assembly mounted to the underside of a portion of a conventional skateboard deck.

The improvement in the skateboard truck assembly 120 will be more apparent when referring to FIGS. 10-12 depicting the truck hanger 122 in a tilted or unlevel configuration relative to the mounting plate 132, such as commonly occurring during a turn or landing on an uneven surface. As shown particularly in FIG. 12, the tapered section 157 of the lower bushing 153 (FIG. 13) includes a compressed side 156 and a stretched or elongated side 158. However, due to the cylindrical lower section 155 being captured by the elongated cylindrical sidewall 143 of the bushing well 141, the lowermost section does not slide or pop out of the bushing well thus generally retaining its cylindrical shape during the turn. The uppermost section 157 is allowed to compress or stretch according to the tilt of the skateboard deck 137 (FIG. 14) and attached mounting plate 132 relative to the hanger 122. The flat upper surface 159 maintains contact with the undersurface 146 of the flange 124 throughout the tilting maneuver thus imparting a natural resistance to the turn or tilt fulfilling one purpose of the bushing. This contact between the upper surface 159 of the bushing 153 and lower surface 146 of the kingpin receiving (or hanger) flange 124 along with the enlarged, outwardly tapering section 157 rolling at least partially over the proximate uppermost edge 147 of the well 141 cooperate to instill a tendency of the hanger to return to an untilted or level position relative to the mounting plate. With the bottom section 155 remaining captured in the bushing well 141, there is no need to reset the bushing back to the middle. This eliminates any significant elongation or deformation of the central bore 161 of the bushing 153 about the kingpin 152. In addition, the curved upper arch surface 149 of the well 141 provides a gentle edge to prevent chewing up the bushing 153 in stark contrast to the sharp edge of conventional cup washers.

As with other skateboard truck assemblies, the kingpin nut 154 may be tightened or loosened to vary the relative tightness or looseness of the trucks. However, it will be appreciated the skateboard truck assembly disclosed herein may allow for increased instability to allow a greater degree of freedom for maneuverability while avoiding the displacement and deformation of conventional truck assemblies. Overall, the bushing well and associated bushing features cooperate to preserve the original shape of the bushing 153 and reduce significant wear and tear over time while also preserving the ability to vary the ride characteristics by tightening or loosening the kingpin nut. It will be further appreciated that the shape of the mounting plate side bushing 153 with the lower section 155 fitting within or otherwise plugged into the bushing well 141 or complementary form cavity in the mounting plate 132 (base plate) and the frustoconical upper section 157 allows for a looser truck adjustment resulting in favorable instability for making quicker turns while also retaining a favorable spring return to center where stability is preferred such as when riding straight ahead or coming out of a turn and returning to a level riding position. The use of a lower kingpin 152 (and kingpin adjustment nut 154) in the baseplate 132 is made possible from the reduced range of adjustment of the adjustment nut needed to achieve a loose ride while avoiding typical side effects from doing so, such as wheel rub. Compared to a conventional truck assembly, the kingpin adjustment nut 154 may be turned in the loosening direction less than a conventional kingpin nut and still provide the desired quick turning ride and return to center ride characteristics while inhibiting or reducing the likelihood of wheel rub.

Materials and methods of manufacturing: Conventional materials used for manufacturing skateboard trucks may be used. The captured bushing may be made by pouring or casting into a mold shaped to produce the captured bushing with kingpin receiving hole. This avoids the expense and manufacturing difficulties relating to overmolding or fusing a two-piece bushing. The mounting plate with the bushing well may be made by casting, pouring, stamping, grinding, drilling, die-casting, or other suitable metal working process.

In accordance with this disclosure and the embodiments herein, an improved skateboard truck assembly may comprise a truck hanger having an axle section with opposing wheel receiving ends, the hanger further having a pivot pin extension and a kingpin receiving flange with an aperture, the truck assembly further including amounting plate with a pivot cup receiving the pivot pin extension of the truck hanger and further including a well with a bottom surface and surrounding collar or sidewall extending toward the truck hanger and terminating in a truck hanger facing rollover edge, a first bushing extends between the hanger flange and the bottom surface of the well, the first bushing having a first diameter at least partially captured in at least a portion of the well and a second expanded diameter extending beyond the rollover edge, the first bushing further including an end abutting a surface of the hanger flange, and a second bushing secured between an opposing second surface of the hanger flange and a fastener with a kingpin passing through the bushings and flange and securing the hanger to the mounting plate with the pivot pin nested in the pivot cup.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the invention (s) includes all novel and nonobvious combinations and sub-combinations of the various elements, features, functions, and/or properties disclosed herein. The following claims particularly point out certain combinations and sub-combinations regarded as novel and nonobvious. Other combinations and sub-combinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A truck assembly for use with a skateboard deck and a set of skateboard wheels, the truck assembly comprising:

a truck hanger having an elongated axle section with opposing wheel receiving ends, the truck hanger further having a pivot pin extension and a kingpin receiving flange with an aperture;

a mounting plate having a mounting surface for securing against the skateboard deck, the mounting plate further having a pivot cup receiving at least a portion of the pivot pin extension of the truck hanger and further having a bushing receiving well at least partially defined by a sidewall extending from the mounting plate and terminating in a truck hanger facing rollover edge;

a first bushing extending from a first surface of the kingpin receiving flange and into at least a portion of the well between the sidewall, the first bushing having a first section with a first substantially constant diameter at least partially captured in at least a portion of the well that projects between the rollover edge and a bottom surface of the well and a second section expanding outwardly from the first diameter as the second section projects between the rollover edge and the kingpin receiving flange, the first bushing further including a first bore and a first end abutting the first surface of the kingpin receiving flange;

a second bushing including a second bore aligned with the first bore of the first bushing when the truck hanger is untilted relative to the mounting plate, the second bushing further including a lower surface abutting an opposing second surface of the kingpin receiving flange;

a kingpin passing through the bores of the bushings and the aperture of the kingpin receiving flange to position the first bushing between the kingpin receiving flange with the first section of the first bushing at least partially within the well and also position the second bushing against the second surface of the kingpin receiving flange; and, a nut secured to one end of the kingpin to sandwich the second bushing between the nut and the kingpin receiving flange and to pivotally and removably secure the truck hanger to the mounting plate with the pivot pin at least partially nested in the pivot cup.

2. The truck assembly of claim 1 wherein:

the rollover edge is rounded over to prevent the first bushing from being damaged as the truck hanger tilts relative to the mounting plate.

3. The truck assembly of claim 1 wherein:

the second section of the first bushing tapers outwardly from the rollover edge when the first section is positioned within the well and terminates in an enlarged diameter surface that maintains flush contact with the first surface of the kingpin receiving flange when the truck hanger is tilted relative to the mounting plate.

4. The truck assembly of claim 1 further including:

a cup washer sandwiched between the nut and the uppermost surface of the second bushing.

5. The truck assembly of claim 1 wherein:

a first central longitudinal axis passing through the well intersects a second central longitudinal axis passing through the pivot cup.

6. The truck assembly of claim 1 wherein:

the second section of the first bushing remains restrained from lateral movement by the sidewall of the well as the truck hanger pivots relative to the mounting plate.

7. The truck assembly of claim 1 wherein:

the second section of the first bushing is pinched between the truck hanger and rollover edge as the truck hanger pivots relative to the mounting plate on one side while expanding on the opposing side without deforming a portion of the bore passing through the first section of the first bushing relative to the kingpin.

8. The truck assembly of claim 1 wherein:

the second bushing has a frusto-conical profile.

9. The truck assembly of claim 1 wherein:

the sidewall of the well surrounds a perimeter of the first section of the first bushing and a lowermost surface of the first section remains in abutment with a bottom surface of the well when the truck hanger is tilted relative to the mounting plate.

10. The truck assembly of claim 1 wherein:

the surface of the second section of the first bushing abutting the kingpin receiving flange is flat.

11. The truck assembly of claim 1 wherein:

the first and second sections of the first bushing are approximately the same height along an axis projecting through the bore of the first bushing with a transition in diameter being disposed approximate the rollover edge.

12. The truck assembly of claim 1 wherein:

the well is substantially hollow except for the kingpin projecting therethrough.

13. The truck assembly of claim 1 wherein:

a pinched portion of the second section of the first bushing resulting from tilting the truck hanger relative to the mounting plate cooperates with the kingpin receiving flange of the truck hanger and the rollover edge to restore an untilted orientation of the truck hanger relative to the mounting plate.

14. The truck assembly of claim 1 wherein:

the first section of the first bushing is prevented from escaping from the well when the truck hanger tilts relative to the mounting plate.

15. The truck assembly of claim 1 wherein:

the bores of the bushings are aligned for receipt of the kingpin.

16. A truck assembly for use with a skateboard deck and a set of skateboard wheels, the truck assembly comprising:

a truck hanger having an elongated axle section with opposing wheel receiving ends, the truck hanger further having a pivot pin extension and a hanger flange with an aperture;

a mounting plate having a mounting surface for securing against an underside of the skateboard deck, the mounting plate further having a pivot cup receiving at least a portion of the pivot pin extension of the truck hanger and further including a capturing well with a bottom surface and at least a partially surrounding sidewall extending toward the truck hanger and terminating in a rounded rollover edge;

a multi-section bushing extending between a first surface of the hanger flange and the bottom surface of the well, the multi-section bushing having a first section with a constant diameter at least partially disposed in the well and restricted from lateral movement due the sidewall of the well, the multi-section bushing further including an outwardly tapering second section extending from the first section proximate the rollover edge, the multi-section bushing further including a first bore and a first end abutting a surface of the hanger flange:

a frusto-conical bushing including a second bore aligned with the first bore of the first bushing when the truck hanger is untilted relative to the mounting plate, the second bushing further including a lower surface abutting an opposing second surface of the hanger flange;

a first fastener passing through the bores of the bushings and the aperture of the hanger flange to position the first bushing between the hanger flange and the bottom of the well and also position the second bushing against the second surface of the hanger flange; and, a complementary fastener secured to the first fastener to sandwich the second bushing between the complementary fastener and the hanger flange and to pivotally and removably secure the truck hanger to the mounting plate with the pivot pin at least partially nested in the pivot cup.

17. A method of assembling a truck assembly for use with a skateboard deck and a set of skateboard wheels, the method comprising:

providing a truck hanger having an elongated axle section with opposing wheel receiving ends, the truck hanger further having a pivot pin extension and a hanger flange with an aperture;

providing a mounting plate with a mounting surface for securing against the skateboard deck, the mounting plate further having a pivot cup and a bushing capturing well defined by a sidewall terminating in a rollover edge and an opposing bottom surface;

providing a first bushing having a first section with a substantially constant first diameter and a second section expanding outwardly from the first diameter, the first bushing further including a first bore;

providing a second bushing including a second bore;

providing a first fastener constructed to pass through the bores of the bushings and the aperture of hanger flange;

providing a complementary fastener for securing to one end of the first fastener;

inserting the first fastener into the well of the mounting plate;

sliding the bore of the first bushing over the first fastener to nest the first section of the first bushing within the sidewall of the well and between the bottom surface of the well and the rollover edge and further position the second expanding section of the first bushing outside the well and abutting the rollover edge leaving a section of the first fastener exposed;

sliding the aperture of the hanger flange of the truck hanger over the exposed section of the first fastener and at least partially inserting the pivot pin extension into the pivot cup of the mounting plate to sandwich the first bushing between a first surface of the hanger flange and the bottom surface of the well leaving a portion of the first fastener projecting through the hanger flange;

sliding the second bushing over the first fastener projecting through the hanger flange to abut the hanger flange leaving a distal end of the first fastener exposed; and securing the complementary fastener on the distal end of the first fastener to sandwich the second bushing between the complementary fastener and the hanger flange.

18. The method of claim 17 further comprising:

providing a cup washer;

placing the cup washer over one end of the second bushing prior to securing the complementary fastener to the distal end of the first fastener.

19. The method of claim 17 further comprising:

adjusting the complementary fastener to tighten or loosen the truck hanger relative to the mounting plate.

* * * * *